US005969685A

United States Patent [19]

Hayes et al.

[11] Patent Number: 5,969,685

[45] Date of Patent: Oct. 19, 1999

[54] PIVOTABLE MULTIPLE FREQUENCY BAND ANTENNA WITH CAPACITIVE COUPLING

[75] Inventors: Gerard James Hayes, Wake Forest; Kim Rutkowski, Raleigh; Charles Rudisill, Apex; Russell Evans Winstead, Raleigh, all of N.C.

[73] Assignee: Ericsson Inc., Research Triangle Park, N.C.

[21] Appl. No.: 09/136,007

[22] Filed: Aug. 17, 1998

[51] Int. Cl.[6] ..... H01Q 1/24

[52] U.S. Cl. ..... 343/702; 343/860; 343/834; 343/882

[58] Field of Search ..... 343/702, 860, 343/862, 839, 834, 845, 882, 700 MS

[56] References Cited

U.S. PATENT DOCUMENTS 4,800,392 1/1989 Garay et al. ..... 343/700 MS
5,367,311 11/1994 Egashira ..... 343/749
5,440,315 8/1995 Wright et al. ..... 343/702
5,828,342 10/1998 Hayes et al. ..... 343/702

*Primary Examiner*—Don Wong
*Assistant Examiner*—James Clinger
*Attorney, Agent, or Firm*—Myers Bigel Sibley & Sajovec, P.A.

[57] ABSTRACT

Multiple frequency band antennas are pivotally connected to electronic devices such that coaxial connectors are not required. A dielectric substrate, including a plurality of radiating elements disposed thereon, is pivotally connected to an electronic device housing so as to have a predetermined path of rotation from a first position to a second position. At least one of the radiating elements disposed on the dielectric substrate is maintained in a substantially constant spaced-apart relationship with a conductive element disposed within the housing throughout the predetermined path so as to be capacitively coupled with the conductive element.

26 Claims, 6 Drawing Sheets

85

PIVOTABLE MULTIPLE FREQUENCY BAND ANTENNA WITH CAPACITIVE COUPLING

FIELD OF THE INVENTION

The present invention relates generally to radiotelephones and, more particularly, to radiotelephone antennas.

BACKGROUND OF THE INVENTION

Radiotelephones generally refer to communications terminals which provide a wireless communications link to one or more other communications terminals. Radiotelephones may be used in a variety of different applications, including cellular telephone, land-mobile (e.g., police and fire departments), and satellite communications systems.

Radiotelephones for various electronic devices, including handsets, personal data assistants (PDAs) and lap-top computers, may utilize an antenna that pivots from a stored position to an operating position. Conventionally, a radiotelephone antenna includes a conductor that is electrically connected to a transceiver within the electronic device and another conductor that is connected to ground.

In order to electrically connect both conductors of a conventional pivotable antenna, a coaxial connector is often utilized. Unfortunately, coaxial connectors may be somewhat expensive and can be somewhat bulky. Because radiotelephones and other communications devices are undergoing miniaturization, available space within these devices may be somewhat limited. To facilitate reducing the costs associated with manufacturing radiotelephones, and to accommodate miniaturization, it would be desirable to attach pivotable antennas to radiotelephones without requiring the use of coaxial connectors.

SUMMARY OF THE INVENTION

It is, therefore, an object of the present invention to electrically connect multiple conductors of a pivotable antenna to a radiotelephone or other communications device without requiring a coaxial connector therebetween.

It is another object of the present invention to facilitate reducing the costs associated with radiotelephone manufacturing.

It is yet another object of the present invention to facilitate miniaturization efforts from radiotelephones and other communication devices.

These and other objects of the present invention are provided by multiple frequency band antenna systems for electronic devices, such as radiotelephones, wherein coaxial connectors are not required to connect pivotable antennas to the internal circuitry. According to one embodiment of the present invention, a dielectric substrate includes first and second radiating elements disposed thereon, such that the second radiating element is parasitically coupled with the first radiating element. The housing of an electronic device to which the dielectric substrate is pivotally mounted includes a grounded conductive element disposed adjacent the pivotal mounting.

The dielectric substrate is pivotally connected to the housing and is movable along a predetermined path of rotation from a first position to a second position. The second radiating element maintains a substantially constant spaced-apart relationship with the grounded conductive element throughout the predetermined path of rotation so as to be capacitively coupled with the grounded conductive element. The first radiating element is electrically connected to the internal circuitry throughout the predetermined path of rotation.

According to another embodiment of the present invention, a dielectric substrate includes first and second radiating elements disposed thereon, such that the second radiating element is parasitically coupled with the first radiating element. A conductive element is disposed within the housing and is electrically connected to the transceiver.

The dielectric substrate is pivotally connected to the housing and is movable along a predetermined path of rotation from a first position to a second position. The first radiating element maintains a substantially constant spaced-apart relationship with the conductive element throughout the predetermined path of rotation so as to be capacitively coupled with the conductive element. The second radiating element is electrically connected to ground throughout the predetermined path of rotation.

By eliminating the need for a coaxial connector for connecting a pivotable antenna to the internal circuitry of an electronic device, manufacturing costs may be reduced. Furthermore, pivotable antennas incorporating the present invention can have simplified connections with the internal circuitry of an electronic device which may reduce electronic complexity and may reduce space requirements therewithin. Furthermore, elimination of coaxial connectors, which may become unreliable over time as a result of mechanical wear and tear, may also be a benefit of the present invention.

BRIEF DESCRIPTION OF THE DRAWINGS

The accompanying drawings, which are incorporated in and constitute a part of the specification, illustrate embodiments of the invention and, together with the description, serve to explain principles of the invention.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
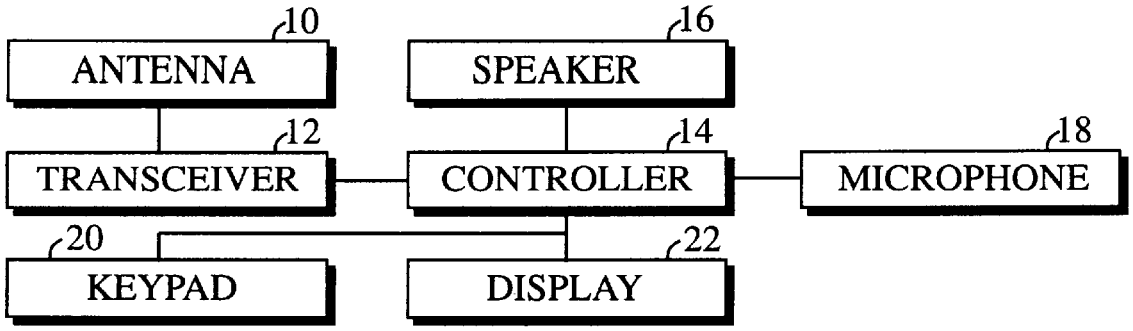
FIG. 1 (PRIOR ART)
FIG. 1 is a schematic illustration of a conventional arrangement of electronic components for enabling a radiotelephone to transmit and receive telecommunications signals.

A conventional arrangement of electronic components that enable a radiotelephone to transmit and receive radiotelephone communication signals is shown schematically in FIG. 1, and is understood by those skilled in the art of radiotelephone communications. An antenna 10 for receiving and transmitting radiotelephone communication signals is electrically connected to a radio-frequency transceiver 12 that is further electrically connected to a controller 14, such as a microprocessor. The controller 14 is electrically connected to a speaker 16 that transmits a remote signal from the controller 14 to a user of a radiotelephone. The controller 14 is also electrically connected to a microphone 18 that receives a voice signal from a user and transmits the voice signal through the controller 14 and transceiver 12 to a remote device. The controller 14 is electrically connected to a keypad 20 and display 22 that facilitate radiotelephone operation. Other elements of radiotelephones are conventional and need not be described herein.

As is known to those skilled in the art of communications devices, an antenna is a device for transmitting and/or receiving electrical signals. A transmitting antenna typically includes a feed assembly that induces or illuminates an aperture or reflecting surface to radiate an electromagnetic field. A receiving antenna typically includes an aperture or surface focusing an incident radiation field to a collecting feed, producing an electronic signal proportional to the incident radiation. The amount of power radiated from or received by an antenna depends on its aperture area and is described in terms of gain.

Conventional radiotelephones may employ an antenna which is electrically connected to a transceiver operably associated with a signal processing circuit positioned on an internally disposed printed circuit board. In order to maximize power transfer between an antenna and a transceiver, the transceiver and the antenna are preferably interconnected such that their respective impedances are substantially "matched," i.e., electrically tuned to filter out or compensate for undesired antenna impedance components to provide a 50 Ohm (Ω) (or desired) impedance value at the circuit feed. Impedance matching systems are well known in the art and need not be discussed further.

Figure 2:
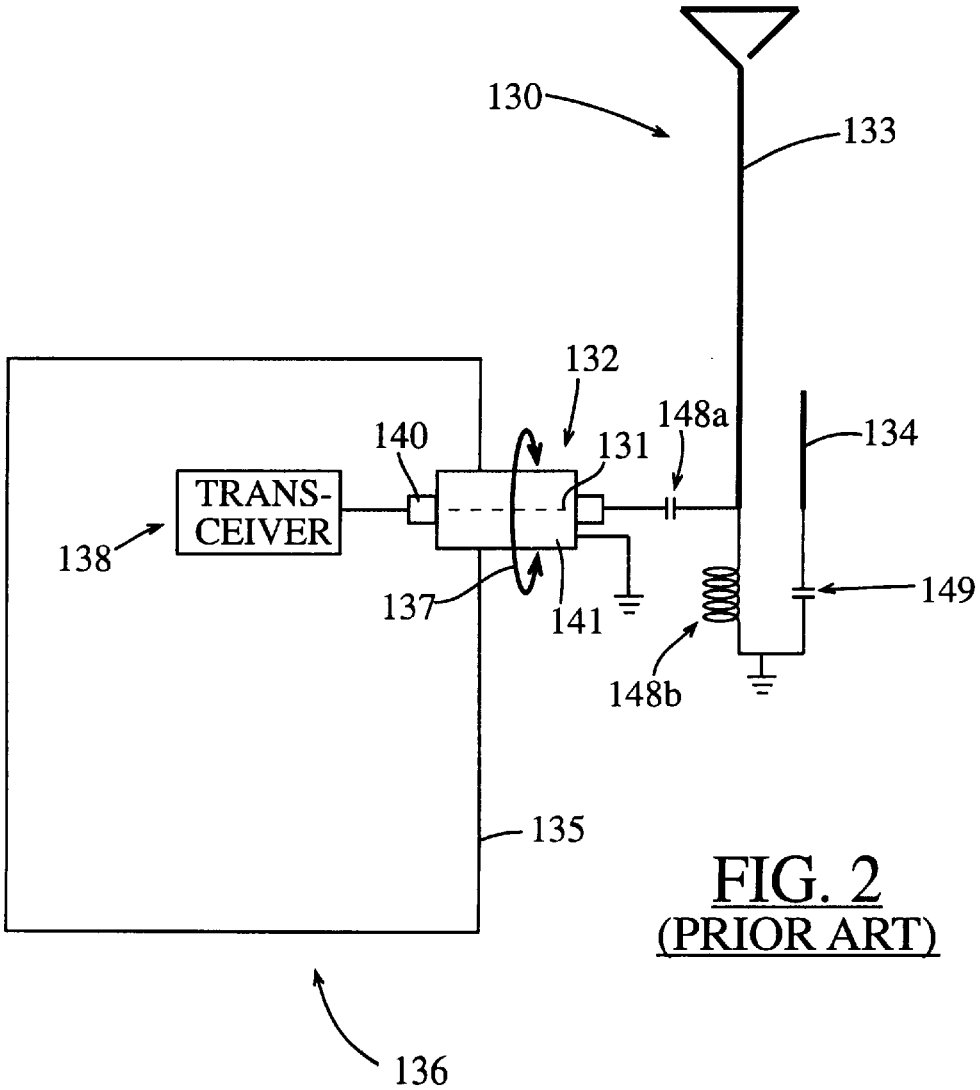
FIG. 2 (PRIOR ART)
FIG. 2 schematically illustrates a conventional radiotelephone antenna configured to pivot about a connection axis with a coaxial connector.

Referring now to FIG. 2, a conventional radiotelephone antenna 130 configured to pivot about a connection axis 131 is schematically illustrated. The antenna 130 includes adjacent first and second radiating elements 133, 134 and is pivotally mounted to the housing 135 of a radiotelephone 136 or other electronic device via a coaxial connector 132. The second radiating element 134 is parasitically coupled with the first radiating element 133. As is known to those skilled in the art of parasitic radiating elements, the first and second radiating elements 133, 134 can jointly resonate within different respective frequency bands. For example, the first radiating element 133 can be tuned to resonate at 800 MHz and the second radiating element 134 can be tuned to resonate at 1900 MHz. Together, the first and second radiating elements 133, 134 enable multiple frequency band radiotelephone operation.

The illustrated antenna 130 rotates about the connection axis 132 along a predetermined path as indicated by the arrow 137. The first radiating element 133 is electrically connected to a transceiver 138 within the radiotelephone 136 via the inner conductor 140 of the coaxial connector 132, as illustrated. The outer conductor 141 of the coaxial connector 132 is electrically grounded and connected to the second radiating element 134 via a capacitor 149. Impedance matching components, represented by 148*a* and 148*b*, are provided, as illustrated, on the antenna side of the coaxial connector 132, for matching the impedance of the first radiating element 133 to the transceiver 138.

Figure 3:
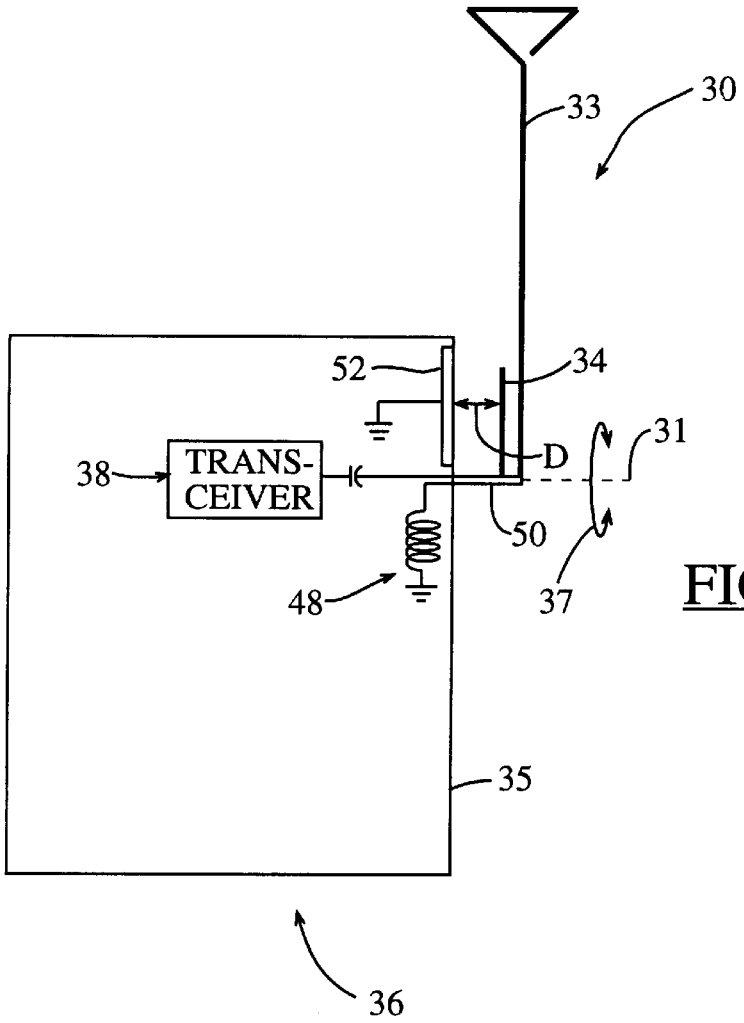
FIG. 3 schematically illustrates a radiotelephone antenna configured to pivot about a connection axis without a coaxial connector according to the present invention.

Referring now to FIG. 3 a pivotable multiple frequency band radiotelephone antenna 30 configured to pivot about a connection axis 31, according to the present invention, is schematically illustrated. The antenna 30 includes first and second radiating elements 33, 34 and is pivotally mounted to the housing 35 of a radiotelephone 36 or other electronic device via a pin 50 or other mechanical device that facilitates rotation. The antenna 30 rotates about the connection axis 31 along a predetermined path as indicated by the arrow 37. The first radiating element 33 is electrically connected to the transceiver 38 within the electronic device housing 35. The second radiating element 34 is not directly connected to the grounded conductive element 52. Instead, the second radiating element 34 is maintained in a spaced-apart relationship with the grounded conductive element 52. Preferably, the grounded conductive element 52 is configured such that a substantially constant spaced-apart relationship (indicated by gap D) between the second radiating element 34 and the grounded conductive element 52 is maintained throughout the predetermined path of rotation. The second radiating element 34 utilizes the gap D to create an accurate capacitance to ground.

The illustrated antenna 30, according to the present invention, eliminates the need for a ground contact at the plane of rotation. Accordingly, a coaxial connector is not required. A ground contact is replaced functionally by moving the impedance matching components 48 (a series capacitor and shunt inductor) to the transceiver circuitry and using the gap D between the antenna 30 and the housing 35 as a capacitive coupling to ground.

Preferably, the antenna 30 is configured to pivot about the connection axis 31 so that the gap D is substantially constant. A dielectric spacer may be utilized to facilitate maintaining a substantially constant gap between the second radiating element 34 and the grounded conductive element 52. As the antenna 30 rotates around its predetermined path of travel, the gap D, and the corresponding capacitance that results from gap D, remains substantially constant and, thereby, controlled. Accordingly, the antenna 30 may achieve multiple frequency band performance independent of rotation position.

Alternatively, the first radiating element 33 could be capacitively coupled with a conductive element position on or within the housing 35. The second radiating element 34 may then be directly connected to ground throughout the predetermined path of rotation.

Figure 4A:
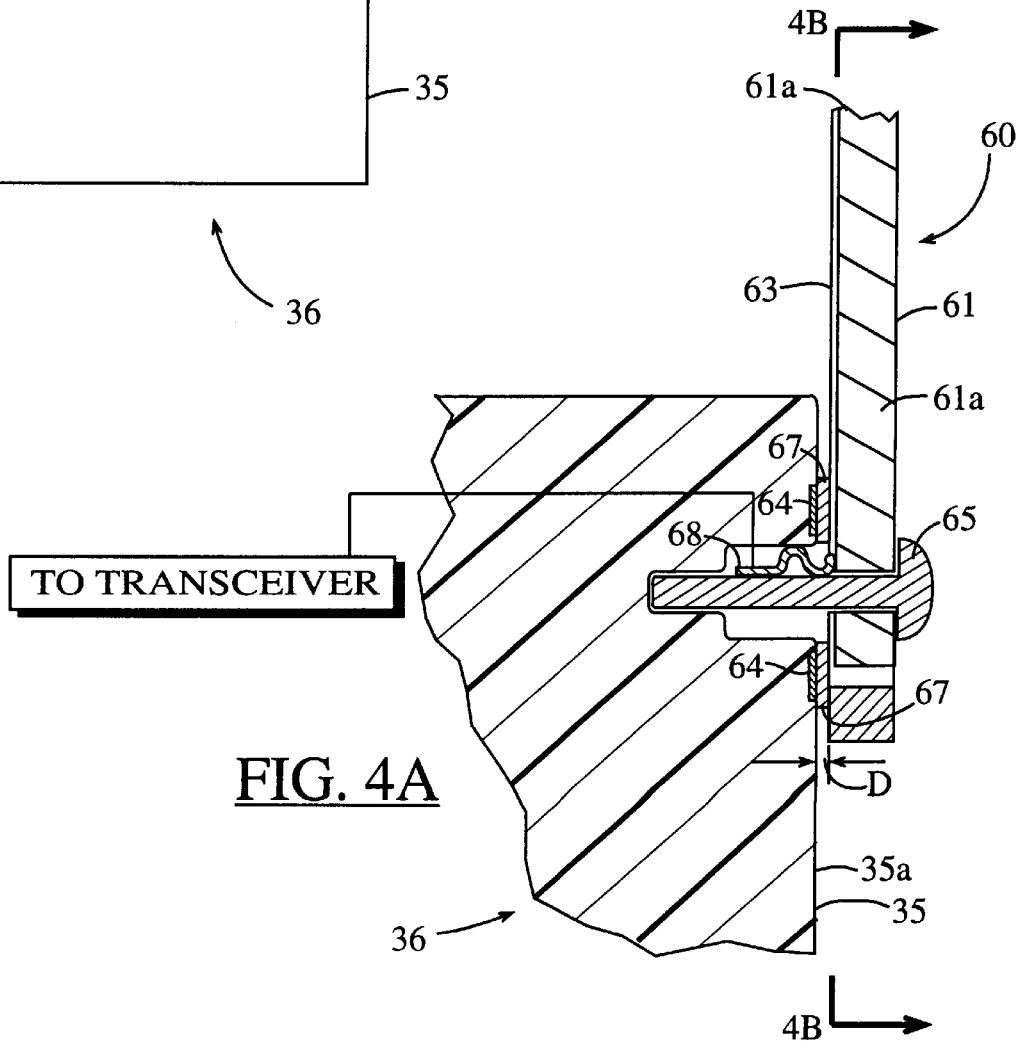
FIG. 4A illustrates a pivotable multiple frequency band antenna system according to one embodiment of the present invention.
Figure 4B:
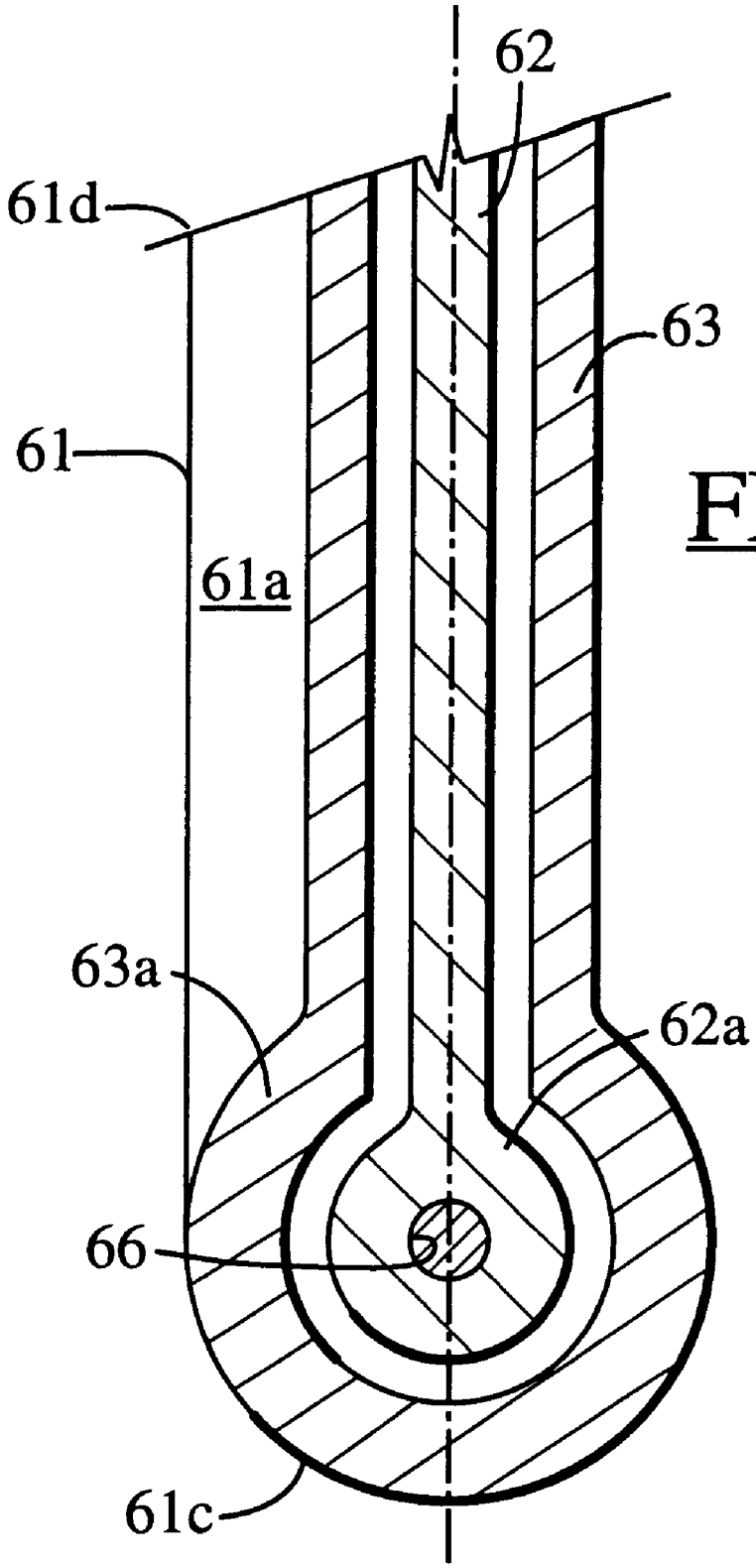
FIG. 4B is a section view taken along lines 4B—4B of FIG. 4A.

Referring now to FIGS. 4A and 4B, a multiple frequency band radiotelephone antenna system 60, according to one embodiment of the present invention, is illustrated. The illustrated antenna system 60 includes an elongated dielectric substrate 61 having opposite first and second faces 61*a*, 61*b* and opposite proximal and distal ends 61*c*, 61*d*. The dielectric substrate 61 is pivotally mounted to a substantially planar side portion 35*a* of the housing 35 of an electronic device 36 via a pin 65 that extends through an aperture 66 formed in the proximal end 61*c* of the dielectric substrate 61 and is secured within an aperture 69 in the housing, as illustrated. Various methods of pivotally attaching antennas to the housings of electronic devices are known, and need not be described further.

In the illustrated embodiment, conductive material is disposed on the dielectric substrate first face 61*a* to form a first radiating element 62. The position and configuration of the first radiating element 62 is not limited to the illustrated embodiment. For example, the first radiating element 62 may be disposed on the second face 61*b* or may be disposed on both the first and second faces 61*a*, 61*b*.

In the illustrated embodiment, the first radiating element 62 has an arcuate portion 62*a* that is configured to extend around the aperture 66 in the dielectric substrate 61. A radio frequency (RF) contact 68 serves as means for electrically connecting the first radiating element 62 to the transceiver (not shown) within the radiotelephone 36. The RF contact 68 is configured to maintain contact with the arcuate portion 62*a* of the first radiating element 62 throughout the predetermined path of rotation of the dielectric substrate 61.

Another layer of conductive material is disposed on the dielectric substrate first face 61*a* to form a second radiating element 63, as illustrated. The second radiating element 63 may also have various shapes and configurations, and is not limited to the illustrated configuration. The second radiating element 63 is preferably parasitically coupled with the first radiating element 62 to enable multiple frequency band operation, as described above. It is to be understood that more than two radiating elements may be disposed upon a dielectric substrate of an antenna system incorporating aspects of the present invention.

Exemplary materials from which the dielectric substrate 61 may be formed include polymeric materials, such as fiberglass, Teflon®, polycarbonate, and the like. Preferably, the dielectric substrate 61 has a dielectric constant between about 2.0 and about 5.0. However, it is to be understood that dielectric substrates having different dielectric constants may be utilized without departing from the spirit and intent of the present invention. In addition, the first and second radiating elements 62, 63 may be molded directly into the dielectric substrate 61, as would be known to those skilled in this art.

As illustrated in FIG. 4B, the second radiating element 63 includes an arcuate portion 63*a* that extends around, and substantially concentric with, the first radiating element arcuate portion 62*a*. A grounded conductive element 64 is disposed within the housing 35 and is substantially concentric with the housing aperture 69. Alternatively, the grounded conductive element 64 may be disposed on a surface of the housing 35 or within the material of the housing 35. In the illustrated embodiment, a dielectric spacer 67 is positioned between the dielectric substrate 61 and the housing of the body to facilitate maintaining a substantially constant gap D between the second radiating element 63 and the grounded conductive element 64. The illustrated dielectric spacer 67 may also serve the function of a mechanical wear ring. Preferably, the dielectric spacer 67 has a low coefficient of friction to facilitate smooth rotational movement of the dielectric substrate 61.

Preferably, the second radiating element 63 is spaced apart from the grounded conductive element 64 such that the gap D is maintained between about 0.01 mm and about 5.0 mm. The gap D may be increased or decreased by adjusting the surface area of the second radiating element 63. As the surface area is increased, the gap D may be correspondingly decreased. Similarly, as the surface area is decreased, the gap D may be correspondingly increased.

Figure 5A:
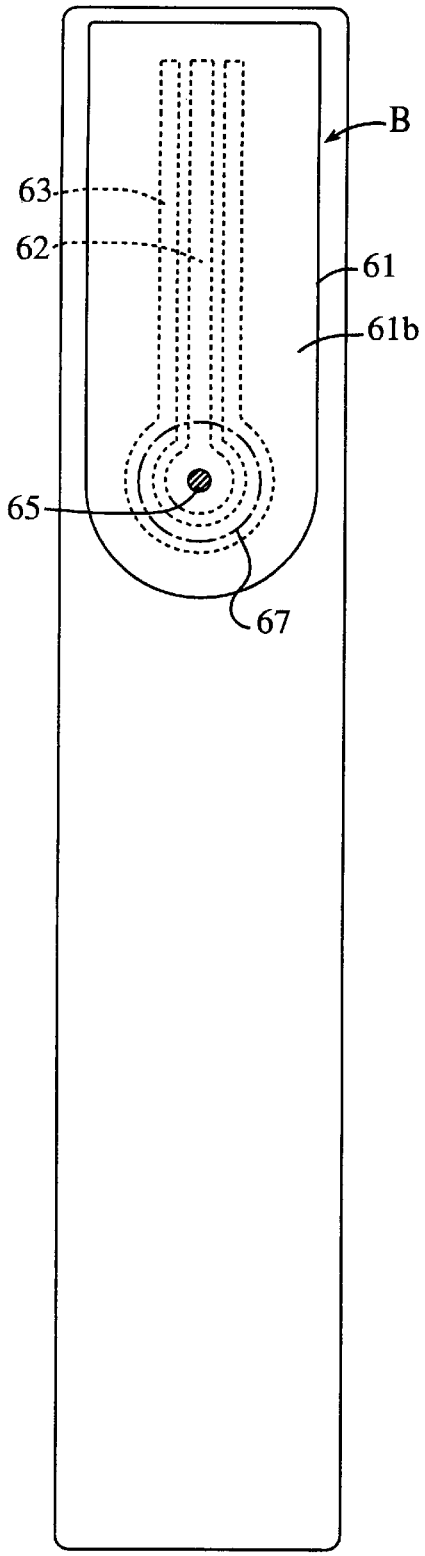
FIGS. 5A-5B are side elevation views of the antenna system of FIGS. 4A and 4B illustrating movement of the antenna from a first position (FIG. 5A) to a second position (FIG. 5B) along a predetermined path of rotation.
Figure 5B:
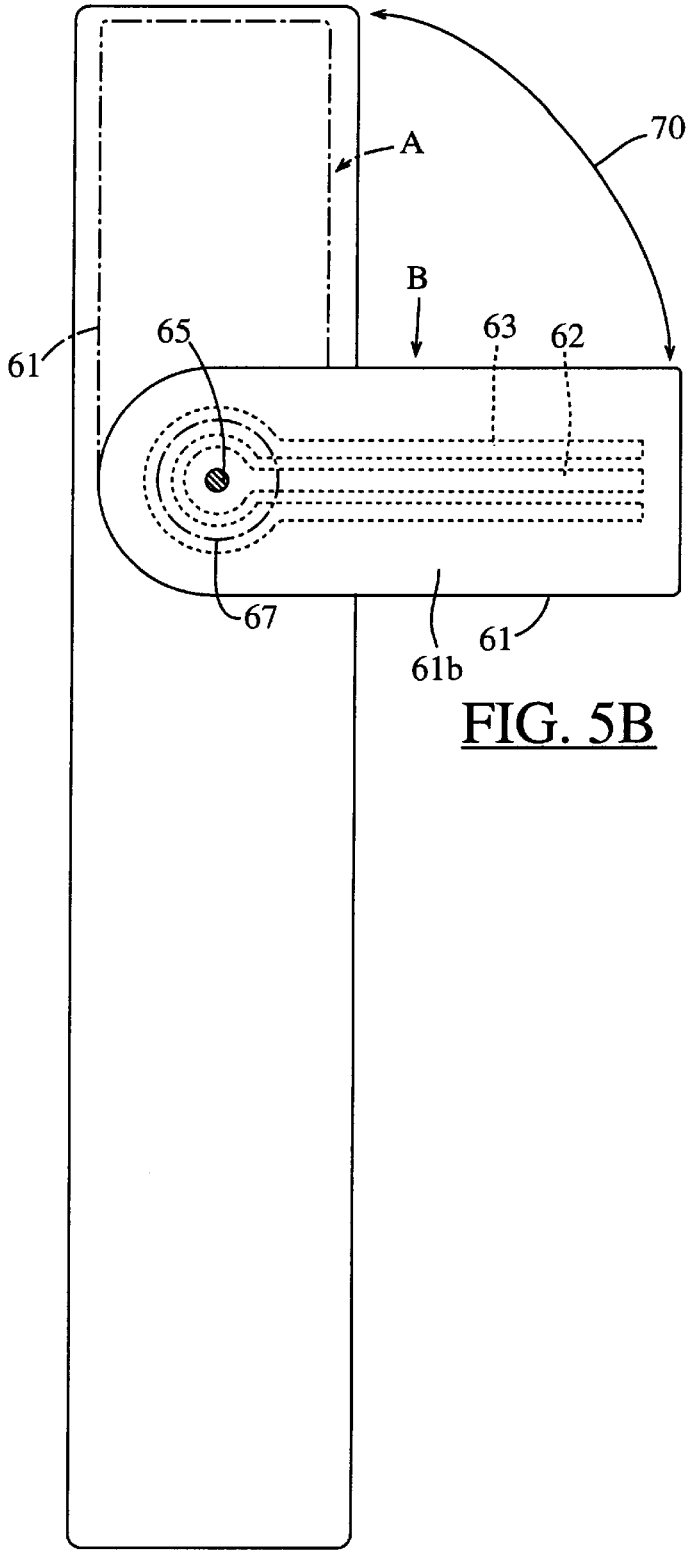

Referring now to FIGS. 5A-5B, side elevation views of the antenna system 60 of FIGS. 4A and 4B illustrates movement of the dielectric substrate 61 from a first position B (FIG. 5A) to a second position A (FIG. 5B) along a predetermined path of rotation, indicated by arrow 70. The antenna system 60 is configured so that the first and second radiating elements 62 and 63 may resonate within respective frequency bands in both the first and second positions, and in any position along the predetermined path therebetween.

Figure 6A:
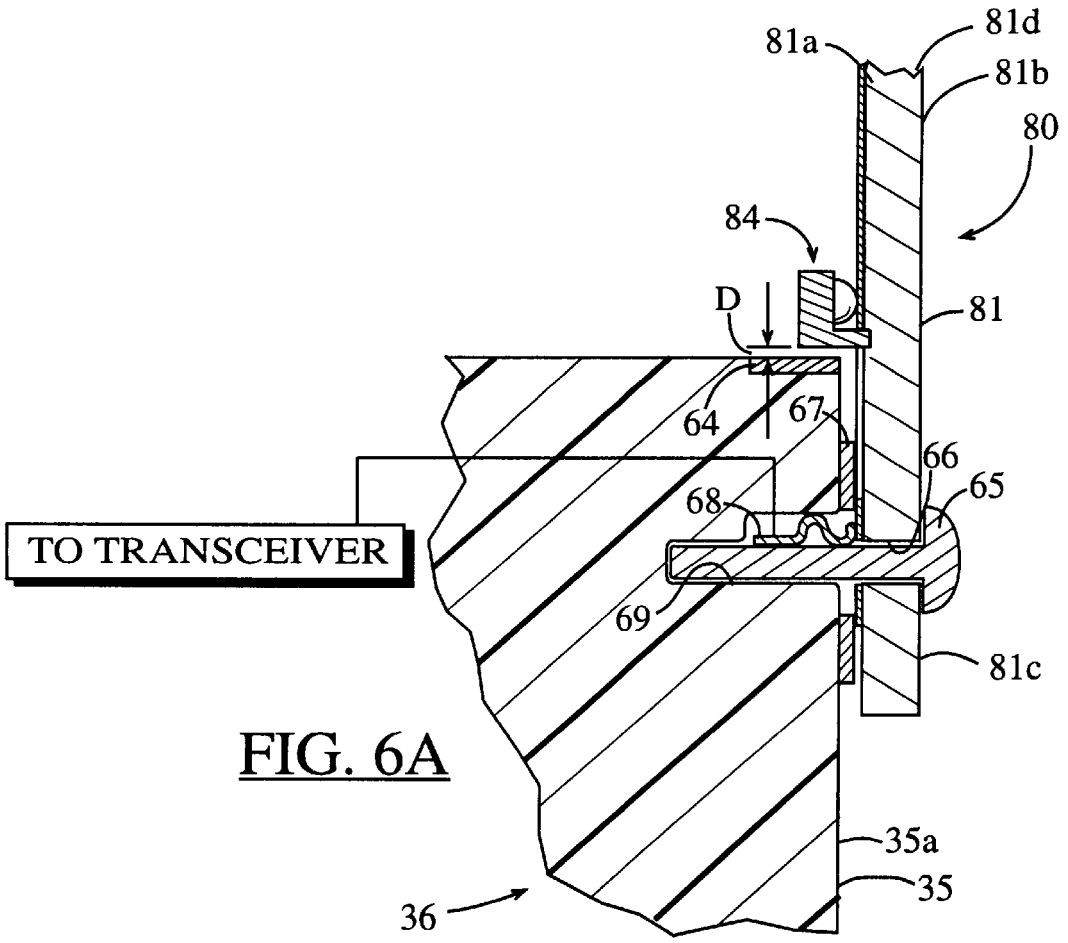
FIG. 6A illustrates a pivotable multiple frequency band antenna system according to another embodiment of the present invention.
Figure 6B:
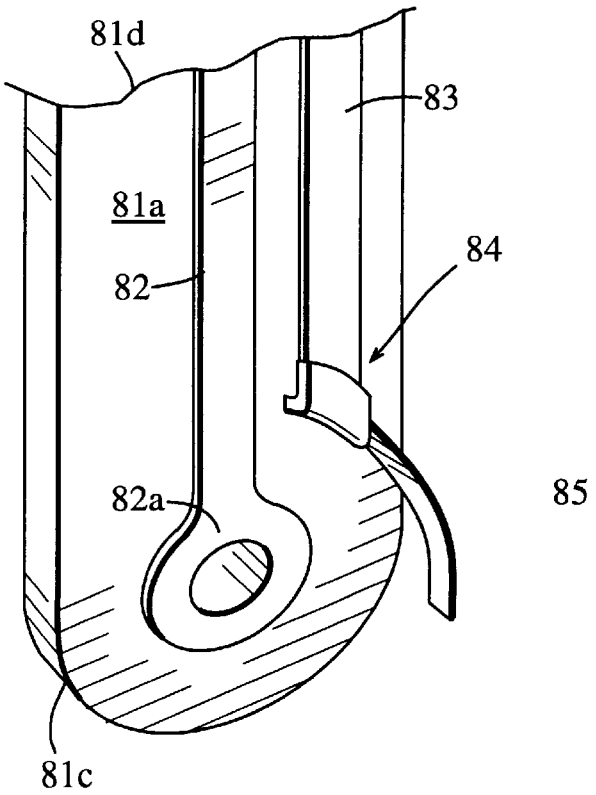
FIG. 6B is a perspective view of the pivotable multiple frequency band antenna of FIG. 6A.

Referring now to FIGS. 6A and 6B, a multiple frequency band radiotelephone antenna system 80, according to another embodiment of the present invention, is illustrated. The illustrated antenna system 80 includes an elongated dielectric substrate 81 having opposite first and second faces 81*a*, 81*b* and opposite proximal and distal ends 81*c*, 81*d*. The dielectric substrate 81 is pivotally mounted, using known techniques, to the housing 35 of the electronic device 36 via a pin 65 that extends through an aperture 66 formed in the proximal end 61*c* of the dielectric substrate 81 and that is secured within an aperture 69 in the housing 35 using known mounting techniques. A first radiating element 82 is disposed on the dielectric substrate first face 81*a*, as illustrated. A second radiating element 83 is disposed on the dielectric substrate first face 81*a* in adjacent spaced-apart relationship with the first radiating element 82, as illustrated. The first and second radiating elements 82, 82 may have various configurations and are not limited to the illustrated embodiment.

In the illustrated embodiment, the first radiating element 82 has an arcuate portion 82*a* that is configured to extend around the aperture 66 in the dielectric substrate 81. An RF contact 68 serves as means for electrically connecting the first radiating element 82 to the transceiver (not shown) within the radiotelephone 36. The RF contact 68 is configured to maintain contact with the arcuate portion 82*a* of the first radiating element 82 throughout the predetermined path of rotation of the dielectric substrate 81.

The second radiating element 83 terminates at a conductive cap plate 84, as illustrated. The conductive cap plate 84 includes an arcuate portion 85 extending therefrom that is configured to maintain a substantially constant spaced-apart relationship with a grounded conductive element 64 disposed within the housing 35.

The illustrated grounded conductive element 64 is disposed within the housing adjacent a side portion 35*b* that is substantially transverse to the substantially planar side portion 35*a* to which the dielectric substrate 81 is pivotally mounted. Alternatively, the grounded conductive element 64 may be disposed on the surface of the side portion 35*b*.

Figure 7A:
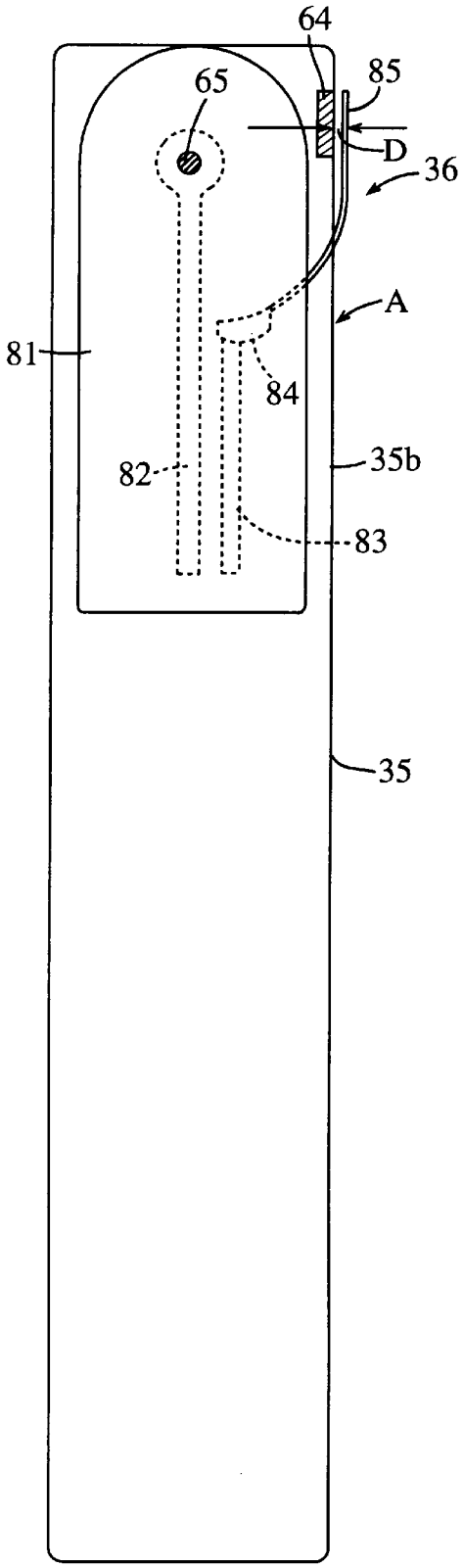
FIGS. 7A-7B are side elevation views of the antenna system of FIGS. 6A and 6B illustrating movement of the antenna from a first position (FIG. 7A) to a second position (FIG. 7B) along a predetermined path of rotation.
Figure 7B:
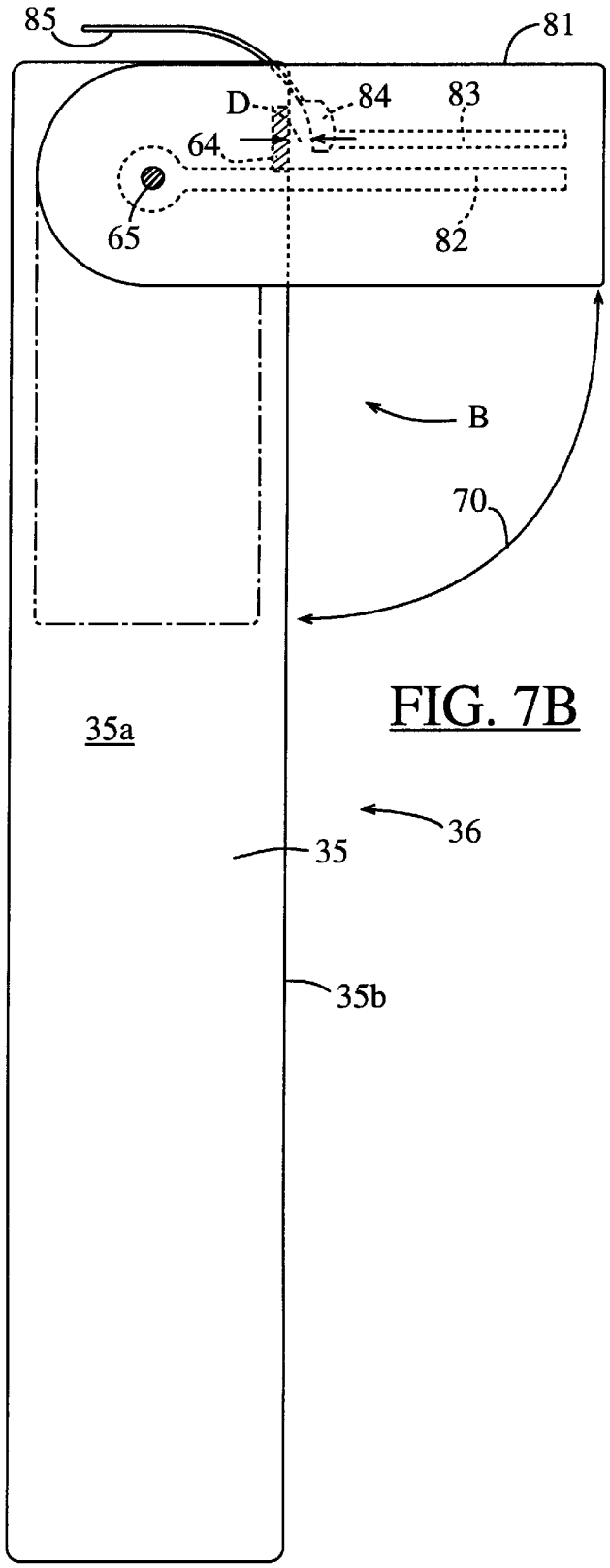

Referring now to FIGS. 7A-7B, side elevation views of the antenna system 80 of FIGS. 6A and 6B illustrates movement of the dielectric substrate 81 from a first position A (FIG. 7A) to a second position B (FIG. 7B) along a predetermined path of rotation, indicated by arrow 70. The antenna system 80 is configured so that the first and second radiating elements 82 and 83 may resonate within respective frequency bands in both the first and second positions, and in any position along the predetermined path therebetween. The conductive cap plate 84 maintains a substantially constant spaced-apart relationship with the grounded conductive element 64 such that the antenna system 80 is operational throughout the predetermined path.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. In the claims, means-plus-function clauses are intended to cover the structures described herein as performing the recited function and not only structural equivalents but also equivalent structures. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The invention is defined by the following claims, with equivalents of the claims to be included therein.

That which is claimed is:

1. A multiple frequency band antenna system for an electronic device, said electronic device comprising a housing enclosing a transceiver for transmitting and receiving radiotelephone communication signals, said multiple frequency band antenna system comprising:

a dielectric substrate;

a grounded conductive element disposed within said housing;

first and second radiating elements disposed on said dielectric substrate, wherein said second radiating element is parasitically coupled with said first radiating element and wherein said second radiating element is capacitively coupled with said grounded conductive element;

means for pivotally connecting said dielectric substrate to said housing such that said dielectric substrate pivots along a predetermined path of rotation from a first position to a second position, and such that said second radiating element maintains a substantially constant spaced-apart relationship with said grounded conductive element throughout said predetermined path of rotation so as to be capacitively coupled with said grounded conductive element throughout said predetermined path of rotation such that an impedance of said second radiating element is matched with an impedance of the transceiver throughout said predetermined path of rotation; and means for electrically connecting said first radiating element to said transceiver throughout said predetermined path of rotation.

2. A multiple frequency band antenna system according to claim 1 wherein said first and second radiating elements resonate within respective first and second frequency bands.

3. A multiple frequency band antenna system according to claim 1 wherein said first and second radiating elements comprise different respective electrical lengths.

4. A multiple frequency band antenna system according to claim 1 wherein said second radiating element is spaced apart from said grounded conductive element between about 0.01 mm and about 5.0 mm.

5. A multiple frequency band antenna system according to claim 1 further comprising a dielectric spacer positioned between said grounded conductive element and said second radiating element.

6. A multiple frequency band antenna system according to claim 2 where in said first radiating element resonates within said first frequency band as a half-wave antenna and wherein said second radiating element resonates within said second frequency band as a quarter-wave antenna.

7. A multiple frequency band antenna system for an electronic device, said electronic device comprising a housing enclosing a transceiver for transmitting and receiving radiotelephone communication signals, said housing comprising an elongated planar side portion, said multiple frequency band antenna system comprising:

a grounded conductive element disposed within said housing;

an elongated dielectric substrate comprising a proximal end, a distal end, and a face;

a first radiating element disposed on said dielectric substrate;

a second radiating element disposed on said dielectric substrate face wherein said second radiating element is parasitically coupled with said first radiating element, and wherein said second radiating element is capacitively coupled with said grounded conductive element;

means for pivotally connecting said dielectric substrate proximal end to said planar side portion such that said dielectric substrate pivots along a predetermined path of rotation from a first position to a second position, and such that said second radiating element maintains a substantially constant spaced-apart relationship with said grounded conductive element throughout said predetermined path of rotation so as to be capacitively coupled with said grounded conductive element throughout said predetermined path of rotation such that an impedance of said second radiating element is matched with an impedance of the transceiver throughout said predetermined path of rotation; and means for electrically connecting said first radiating element to said transceiver throughout said predetermined path of rotation.

8. A multiple frequency band antenna system according to claim 7 wherein said first and second radiating elements resonate within respective first and second frequency bands.

9. A multiple frequency band antenna system according to claim 7 wherein said first and second radiating elements comprise different respective electrical lengths.

10. A multiple frequency band antenna system according to claim 7 wherein said grounded conductive element is disposed on said housing planar side portion.

11. A multiple frequency band antenna system according to claim 7 wherein said second radiating element is spaced apart from said grounded conductive element between about 0.01 mm and about 5.0 mm.

12. A multiple frequency band antenna system according to claim 7 further comprising a dielectric spacer positioned between said grounded conductive element and said second radiating element.

13. A multiple frequency band antenna system according to claim 8 wherein said first radiating element resonates within said first frequency band as a half-wave antenna and wherein said second radiating element resonates within said second frequency band as a quarter-wave antenna.

14. A multiple frequency band antenna system for an electronic device, said electronic device comprising a housing enclosing a transceiver for transmitting and receiving radiotelephone communication signals, said multiple frequency band antenna system comprising:

a dielectric substrate;

a conductive element disposed within said housing, said conductive element electrically connected to said transceiver;

first and second radiating elements disposed on said dielectric substrate, wherein said second radiating element is parasitically coupled with said first radiating element and wherein said first radiating element is capacitively coupled with said conductive element;

means for pivotally connecting said dielectric substrate to said housing such that said dielectric substrate pivots along a predetermined path of rotation from a first position to a second position, and such that said first radiating element maintains a substantially constant spaced apart relationship with said conductive element throughout said predetermined path of rotation so as to be capacitively coupled with said conductive element throughout said predetermined path of rotation such that an impedance of said first radiating element is matched with an impedance of the transceiver throughout said predetermined oath of rotation; and means for electrically connecting said second radiating element to ground throughout said predetermined path of rotation.

15. A multiple frequency band antenna system according to claim 14 wherein said first and second radiating elements resonate within respective first and second frequency bands.

16. A multiple frequency band antenna system according to claim 14 wherein said first and second radiating elements comprise different respective electrical lengths.

17. A multiple frequency band antenna system according to claim 14 wherein said first radiating element is spaced apart from said conductive element between about 0.01 mm and about 5.0 mm.

18. A multiple frequency band antenna system according to claim 14 further comprising a dielectric spacer positioned between said conductive element and said first radiating element.

19. A multiple frequency band antenna system according to claim 15 wherein said first radiating element resonates within said first frequency band as a half-wave antenna and wherein said second radiating element resonates within said second frequency band as a quarter-wave antenna.

20. An electronic device, comprising:

a housing enclosing a transceiver for transmitting and receiving radiotelephone communication signals; and a multiple frequency band antenna system comprising:

a grounded conductive element disposed within said housing;

an elongated dielectric substrate;

first and second radiating elements disposed on said dielectric substrate, wherein said second radiating element is parasitically coupled with said first radiating element and wherein said second radiating element is capacitively coupled with said grounded conductive element;

means for pivotally connecting said dielectric substrate to housing such that said dielectric substrate pivots along a predetermined path of rotation from a first position to a second position, and such that said second radiating element maintains a substantially constant spaced-apart relationship with said grounded conductive element throughout said predetermined path of rotation so as to be capacitively coupled with said grounded conductive element throughout said predetermined path of rotation such that an impedance of said second radiating element is matched with an impedance of the transceiver throughout said predetermined path of rotation; and means for electrically connecting said first radiating element to said transceiver throughout said predetermined path of rotation.

21. An electronic device according to claim 20 wherein said first and second radiating elements resonate within respective first and second frequency bands.

22. An electronic device according to claim 20 wherein said first and second radiating elements comprises different respective electrical lengths.

23. An electronic device according to claim 20 wherein said grounded conductive element is disposed on said housing.

24. An electronic device according to claim 20 wherein said second radiating element is spaced apart from said grounded conductive element between about 0.01 mm and about 5.0 mm.

25. An electronic device according to claim 20 further comprising a dielectric spacer positioned between said grounded conductive element and said second radiating element.

26. An electronic device according to claim 21 wherein said first radiating element resonates within said first frequency band as a half-wave antenna and wherein said second radiating element resonates within said second frequency band as a quarter-wave antenna.

* * * * *